US005877441A

United States Patent [19]

Labute

[11] Patent Number: 5,877,441

[45] Date of Patent: Mar. 2, 1999

[54] DRUM PERCUSSION DEVICE

[76] Inventor: Mauriee H. Labute, 268 Frank Avenue, Windsor, Ontario, Canada, N85 3W8

[21] Appl. No.: 569,954

[22] Filed: Dec. 11, 1995

[51] Int. Cl.[6] ..... G10D 13/02

[52] U.S. Cl. ..... 84/422.1; 84/422.2

[58] Field of Search ..... 84/422.1, 422.2

[56] References Cited

U.S. PATENT DOCUMENTS

| | | | |
|---|---|---|---|
| 1,369,233 | 2/1921 | Fitzgerald | 84/422.2 |
| 3,677,128 | 7/1972 | Simpson | 84/422 |
| 3,967,523 | 7/1976 | Currier | 84/422.1 |
| 4,200,025 | 4/1980 | Currier | 84/422.1 |
| 4,782,733 | 11/1988 | Herring | 84/422.1 |
| 4,819,536 | 4/1989 | Lombardi | 84/746 |
| 5,063,821 | 11/1991 | Battle | 84/723 |
| 5,204,485 | 4/1993 | Lombardi | 84/422.1 |
| 5,388,494 | 2/1995 | Hoshino | 84/422.1 |

OTHER PUBLICATIONS

Authors: Jack Perry with Jack Maher Title "Focal Dystonia: A Personal Experience" Published in the Oct., 1994 Modern Drummer Magazine pp. 76, 77 and 79.

*Primary Examiner*—Michael L. Gellner
*Assistant Examiner*—Shih-yung Hsieh
*Attorney, Agent, or Firm*—The Chupa Law Firm, P.C.

[57] ABSTRACT

A percussion device 10 which allows beaters 14, 16 to independently and/or simultaneously strike drum 128 by use of a single foot.

1 Claim, 4 Drawing Sheets

DRUM PERCUSSION DEVICE

FIELD OF THE INVENTION

This invention relates to a drum percussion device, and more particularly, to a device which allows multiple beaters to independently and/or simultaneously strike a drum by the use of a single foot, thereby allowing virtually unlimited combinations of percussion patterns and rudiments to be created by use of only a single foot.

BACKGROUND OF THE INVENTION

Drum percussion devices are used or deployed to cause various forms or types of generally elongated mechanical members having a generally bulbous striking end, commonly referred to as "beaters," to selectively strike or beat a drum. The beater strike action causes noise to be made or generated which is used as background or as a significant component in an overall music scheme. The amount and type of such noise varies depending upon the force and pattern of the drum impact by the beaters.

While many drum percussion devices exists, it has been found to be very desirable to allow multiple beaters or mechanisms to strike the drum in order to produce multiple types and combinations of sound. That is, a single beater is only capable of producing a rather small and distinct set or amount of different sounds which may not be sufficient to allow many types of music to be performed. A single beater drum percussion device handicaps the drummer and degrades the production of many types of musical compositions due to its inability to provide a multitude of different percussion patterns and combinations. To alleviate these difficulties, many drummers use two single beater devices, each of which are operated by different and opposite feet. Thus, two feet and two separate devices have been used to alleviate these single beater difficulties. To date, Applicant believes that all such prior devices which allow such multiple beaters to strike the drum have required the use of at least two feet and two separate devices.

While the use of such dual single beater devices has increased the different types of percussion combinations which may be produced, they suffer from many drawbacks. For example, and without limitation, the use of both feet has been found to adversely affect the drummer's sense of rhythm since the drummer is required to actively use an unfavored and "un-natural" foot and to synchronize the action of both of these feet, making the task of creating these percussion sounds to be very complex. Secondly, the use of two single beater devices doubles the percussion generation costs and increases the complexity of both the percussion technique and the drum operation.

Moreover, conventional percussion devices require the drummer to continually use only the front portion of the foot. As such, these conventional devices have been known to cause focal dystonia which is a crippling of the front portion of the foot and is thought to be caused by repetitious actuation of these conventional devices by the front portion of the foot. This condition normally prevents a drummer from continuing to perform since the drummer's dysfunctional foot is no longer capable of operating these conventional devices. There is therefore a need for a drum percussion device which reduces the probability of acquiring focal dystonia and which allows a drummer having this condition to continue to perform.

There is therefore also a need for, and it is a principle object of this invention to provide, a device which meets the aforedescribed need relating to focal dystonia and which also allows multiple beaters or generally bulbous ended mechanical members to selectively and independently strike a drum by use of a single foot.

SUMMARY OF THE INVENTION

According to a first aspect of the present invention, a drum percussion device is provided which overcomes many of the deficiencies of the prior art.

According to a second aspect of the present invention, a drum percussion device is provided which allows multiple beaters to selectively strike a drum while obviating the need for a drummer to use both feet and to synchronize foot actions from each foot, thereby allowing the drummer to concomitantly maintain musical rhythm when using the device of the preferred embodiment of the invention.

According to a third aspect of the present invention, a percussion device for use in combination with a drum is provided, the provided device overcomes many of the disadvantages of the prior art and is cost effective. The provided device further allows multiple beaters to selectively, independently, and simultaneously strike a drum by use of a single foot in order to allow relatively unlimited percussion combinations to be selectively created.

According to a fourth aspect of the present invention a drum percussion device is provided which reduces the probability of acquiring focal dystonia and which allows a drummer having this condition to continue to perform by use of the percussion device of the preferred embodiment of the invention.

According to a fifth aspect of the present invention, a percussion device for use in combination with a drum is provided. More particularly, the percussion device of the preferred embodiment of the invention includes a first beater member; a second beater member; and a peddle combination which is movably connected to the first and to the second beater members, and which allows the first and second beater members to independently and simultaneously strike the drum by use of a single foot.

These and other features, objects, and advantages of the present invention will become apparent from a reading of the following detailed description of the invention, by reference to the attached drawings, and by reference to the sub-joined claims included in this application for patent.

DETAILED DESCRIPTION OF THE PREFERRED EMBODIMENT OF THE INVENTION

Figure 1:
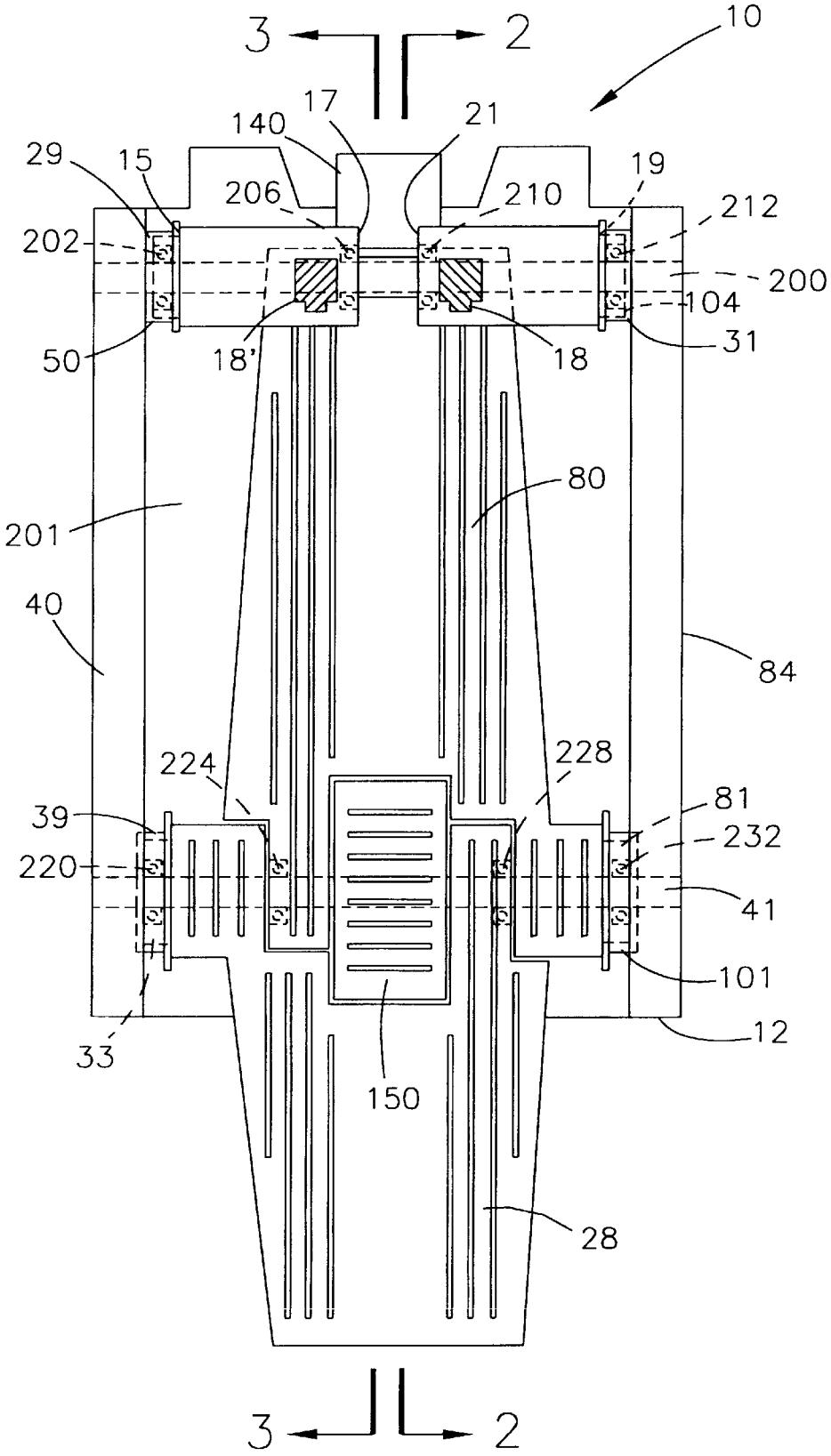
FIG. 1 is a top view of a drum percussion device made in accordance with the teachings of the preferred embodiment of this invention.
Figure 2:
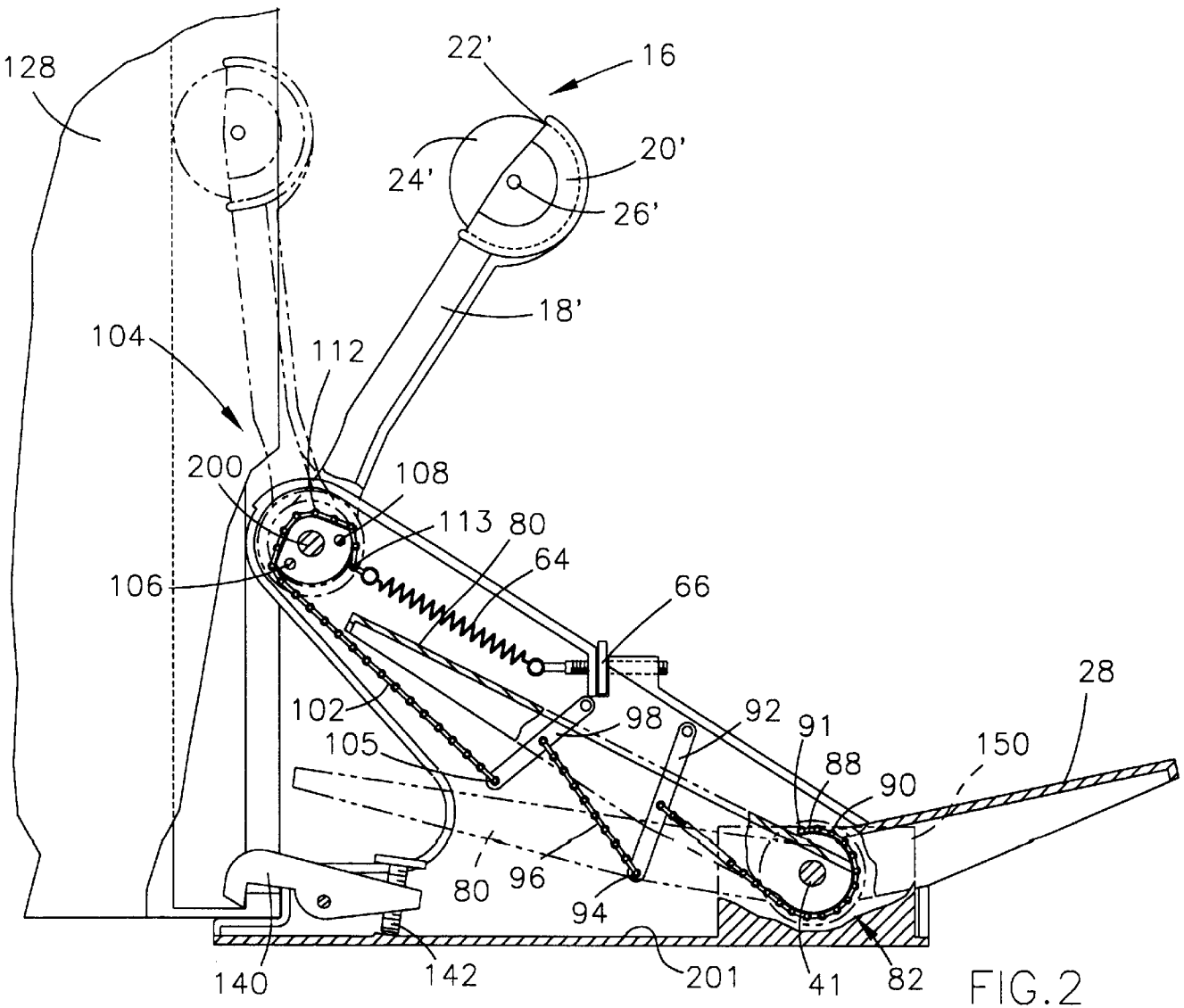
FIG. 2 is a view of the device shown in FIG. 1 taken along view line 2—2 and shown in operational combination with a typical and conventional bass drum.
Figure 3:
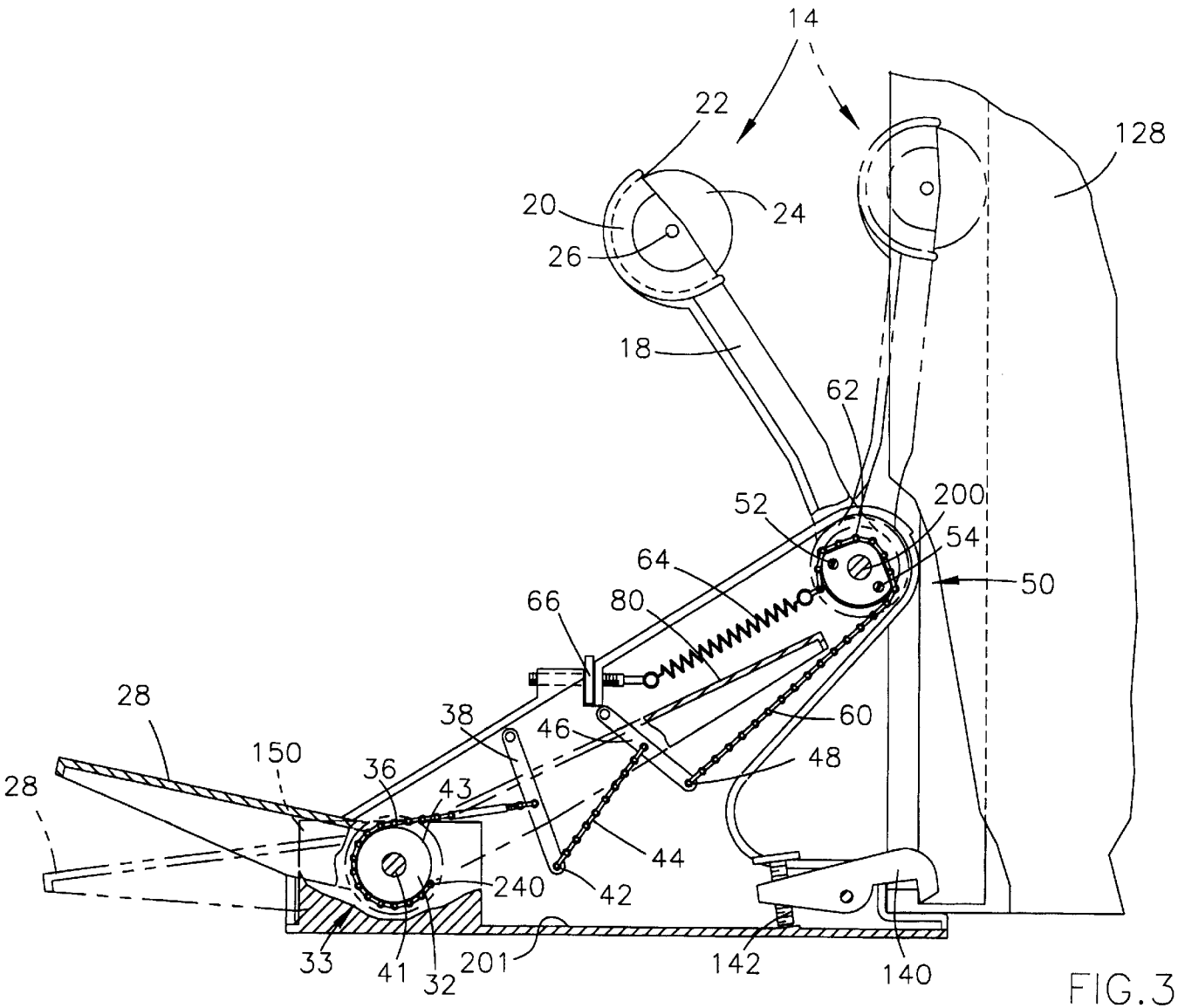
FIG. 3 is a view of the device shown in FIG. 1 taken along view line 3—3 and shown in operational combination with a typical and conventional bass drum.

Referring now to FIGS. 1, 2, and 3 there is shown a drum percussion device 10 which is made in accordance with the teachings of the preferred embodiment of this invention.

More particularly, device 10 includes a case 12 and beater members 14 and 16, which are each selectively and movably deployed within case 12. Each of the beater members 14, 16 has a respectively and generally elongated and columnar stem portion 18, 18' movably connected to and within case 12 and a generally bulbous or rounded respective drum striking end portion 20, 20' having a generally hollow and generally semi-circular respective ball reception portion 22, 22' and a respective ball 24, 24' which is adapted to removably nestle within respective portion 22, 22' by a respective removable pin 26, 26' which may, in one embodiment, traverse through respective balls 24, 24' and respective proportions 20, 20'. In this manner, balls 24, 24' may be easily replaced if one or both becomes worn due to continual contact with drum 128. The choice of materials to create case 12 and beater members 14, 16 is within the skill of those ordinary knowledge of the art. Particularly, case 12 and members 14, 16 may be composed of molded plastic, metal, or a variety of other composite materials. In the preferred embodiment of the invention plastic or a conventional plastic composite material is used to create case 12 and members 14, 16, although aluminum die casting materials may be used. The construction of device 10 has been found to be relatively cost effective.

Figure 4:
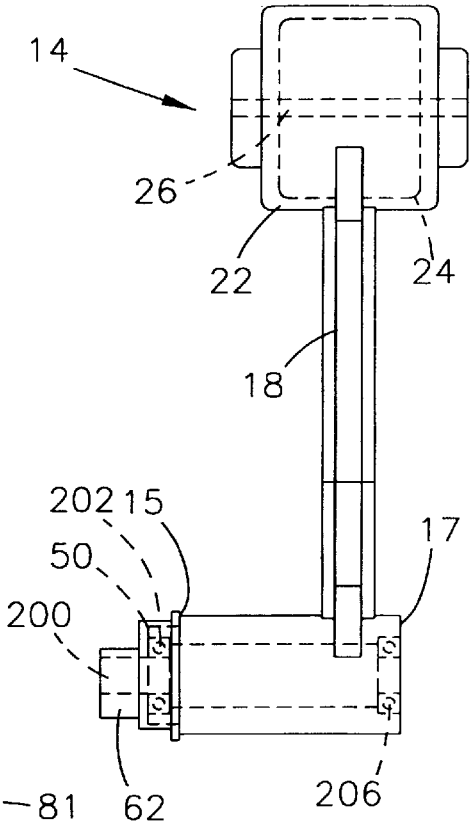
FIG. 4 is a plan and unassembled view of one of the beater members of the device shown in FIG. 1.
Figure 6:
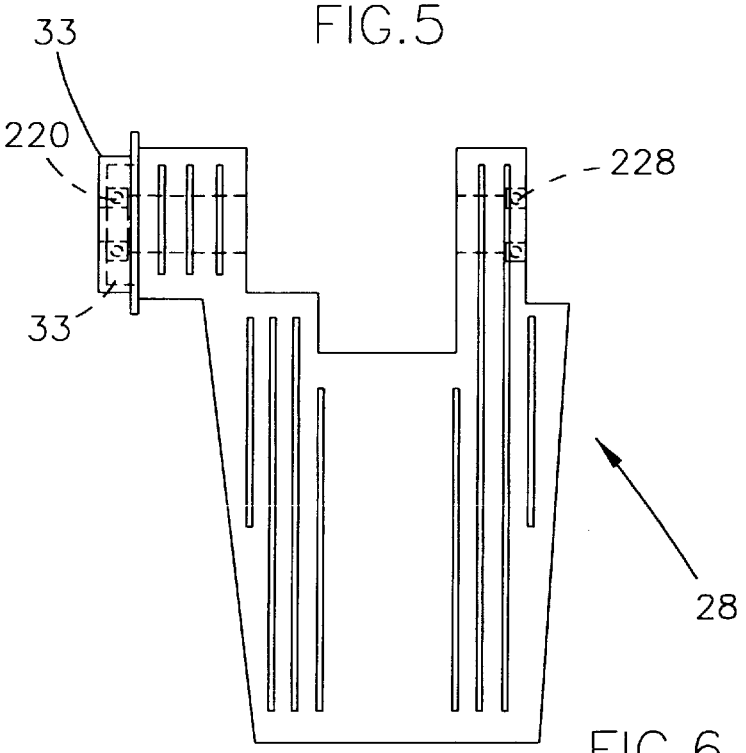
FIG. 6 is a plan and unassembled view of the back peddle of the device shown in FIG. 1.

Each beater member 14, 16 has a generally cylindrical base portion 100 (see FIG. 4) with opposed protruding and generally rounded end portions respectively denoted by reference numerals 15, 17; and 19, 21. Specifically, end portions 19 and 21 correspond to beater 16 while end portions 15 and 17 correspond to beater 14. Portions 15 and 19, as best shown in FIG. 4, are flanged and further include respectively protruding and telescoping generally rounded respective drums 50 and 104. Device 12 also includes a stationary and generally rounded axle member 200 which traverses the width of device 12, which is raised above bottom 201 of case 12 by a distance sufficient to allow rotational movement of portions 100 of beaters 14 and 16 within case 12, and which is coupled to opposite sides 40, 84 of device 12 by conventional means (e.g. axle member 200 may be integrally casted within sides 40, 84 or simply inserted and glued through sides 40, 84). Member 200, as shown best in FIG. 1, traverses through portions 100 of each of the beater members 14, 16 and more particularly, through portions 50, 15 and 17 of member 14 and through portions 21, 19 and 104 of member 16. Bearings 202, 206, 210, and 212 are deployed within case 12 about member 200 and cooperate with member 200 to allow the beaters 14, 16 (e.g. respective portions 100) to be selectively and independently moved within and by device 10 in a manner to be discussed. Portions 15 and 19 are respectively and frictionally received within sockets 29 and 31. Member 200 also traverses such sockets 29, 31. It should be realized by one of ordinary skill in the art that while FIG. 4 shows beater 14 and portions 15, 17, beater 16 and portions 21, 19 are substantially and respectively similar to those shown in and described with respect to FIG. 4. Moreover, as is apparent from FIG. 4, columnar stems 18, 18' are offset from the middle of the base portion 100, thereby being placed further away from respective portions 15, 21 and biased toward respective portions 17, 19. In the preferred embodiment of the invention, beaters 14, 16 are equidistantly positioned with respect to the respective sides 40, 84 of case 12.

Case 12 also includes a back peddle 28 which has a telescoping and generally rounded protruding portion 33 which is movably nestled within and frictionally engaged by and within socket 39. As shown best in FIG. 3, portion 33 includes a generally rounded and generally circular member 32 which is movably attached to case 12 by axle member 41. Member 41, in one embodiment, is substantially similar to member 200, traverses the width of device 12, is raised above the bottom 201 of case 12, and is coupled, in a substantially stationary manner, to case sides 40, 84 while traversing portions 33 and 81. Bearings 220, 224, 228, and 232 are deployed in the vicinity of axle member 41 and allow peddles 28 and 80 to move within device 12.

Portion 33 further has a ledge portion 43 supporting a chain 36 and providing an attachment point for one end of chain 36. Particularly, chain 36 may be soldered to the ledge, attached by a pin, or attached by any other conventional means, such as by use of a commercially available machine screw 240 shown in FIG. 3.

The end of chain 36, opposite the end attached to ledge 43, is attached to about the middle of the length of linkage member 38, by conventional means such as by a machine screw. Member 38 is pivotally and moveable connected to side 40 of case 12 by means of pin or commercially available machine screw 42. The opposite end of member 38 remains unattached to any structure. A chain 44 attaches member 38, at pin 42, to about the middle, by length, of the linkage member 46, by conventional means such as by a machine screw. Member 38 is movably and pivotally attached to side 40 of case 12 by means of pin or commercially available machine screw 48. The opposite end of member 46 remains unconnected to any structure.

As further shown in FIG. 3, portion 15 includes a telescoping and protruding drum member 50 which is movably connected to side 40 of case 12 by means of adjustable screws 52, 54 and member 200. More particularly, as screws 52 and 54 are tightened, drum 50 is allowed or constrained to move only a limited distance. The looser screws 52 and 54 become, the easier it becomes for member 50 to rotate. Drum 50 rotates about member 200. In this manner, screws 52 and 54 are used to adjust the striking force that beaters 14, 16 apply to drum 128. That is, the beater strike force increases in direct proportion to the "looseness" of screws 52, 54.

Drum 50 is connected to pin or commercially available machine screw 48 by a chain 60 which is attached to one portion of drum 50 after passing and resting upon angled ledge 62. Chain 60 may be attached to ledge 62 in the same manner that chain 36 is attached to ledge 43. Drum 50 is further connected to spring 64. Screw adjuster 66 selectively modifies the tension spring 64 allowing spring 64 to be pulled or relieved by moving adjuster 66 into and out of the case 12. Particularly, adjuster 66, in one embodiment, is a conventional screw which is movably received within device 12 and which may be "screwed into and out of" of the device 12 thereby respectively loosening and tightening the spring 64.

In operation, as peddle 28 is moved to the lower position shown in phantom in FIG. 3, drum 32 is rotated counterclockwise thereby creating tension or a "pulling" of chain 36 in a counterclockwise direction (e.g. toward peddle 28). The "pulled" chain 36 causes member 38 to move downward (toward peddle 28), thereby pulling chain 44 downward toward peddle 28. The downward movement of chain 44 causes member 46 to move downward, toward peddle 12, which causes chain 60 to be pulled downward, toward peddle 12. As chain 60 is pulled downward, the chain 60 frictionally engages angle ledge portion 62 causing drum 50 and portion 100 to rotate, thereby causing beater 14 to strike drum 128 (shown in phantom FIG. 3). It should be realized that the angled nature of ledge portion 62 causes the beater member 14 to "snap" against the drum as the chain traverses the angled ledge since the angled ledge requires a certain rotation force to be achieved before overcoming the created inertia. That is, the angled ledge requires a relatively large force to initially move drum 50. Once this force is achieved (e.g. enough force to overcome the dampening effect of the ledge), the drum rotates quickly thereafter. In the preferred embodiment of the invention, angle 200 is about ninety degrees. As peddle 28 is released (moves upward), tension is released in chains 36, 44 and 60; and spring 64 moves beater 16 back to its non-drum contacting position. In this manner, the depression of peddle 28 causes beater 16 to selectively strike the drum 128.

Figure 5:
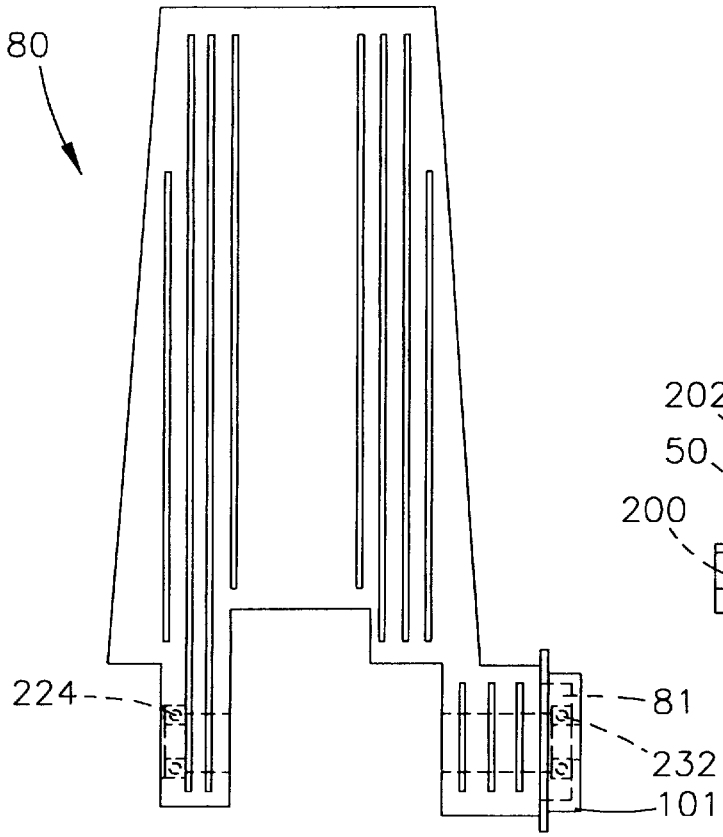
FIG. 5 is a plan and unassembled view of the front peddle of the device shown in FIG. 1.

Turning now to FIGS. 1, 2, and 5 it is shown that device 10 further includes a front peddle 80 which has a telescoping protruding portion 81 which is movably nestled within and frictionally engaged by socket 101. As shown best in FIG. 2, portion 81 has a generally rounded and protruding drum member 82 which is secured to case side 84 by means of axle member 41 and further has a ledge portion 88 upon which chain 90 rests and is connected by pin or commercial available machine screw 91.

Chain 90 is connected to about the midpoint of the length of linkage member 92 in a conventional manner, such as by use of a machine screw. Member 92 is secured to side 84 by pin or commercially available machine screw 94 and has an opposite end which is unconnected to any structure. Chain 96 connects member 92 to about the midpoint of the length of linkage member 98 in a conventional manner, such as by use of a machine screw. Member 98 is secured to case side 84 by pin or commercially available machine screw 105. Chain 102 connects member 98 at pin or machine screw 105 to drum member 104 which is pivotally and movably connected to case side 84 by adjustable screws 106, 108 and by axle member 200. Member 108 further includes an angled ledge portion 112 which supports chain 106 and which, in the preferred embodiment, ledge portion 112 is substantially similar to ledge portion 62. Chain 106 is further connected to member 112 by a pin or commercially available machine screw 113. As before, the screws 106, 108 are used to selectively free or restrain the movement of member 104.

In operation, as front peddle 80 is depressed (shown in phantom FIG. 2), drum 82 moves in a counterclockwise direction causing chain 90 to move member 92 downward toward peddle 80. The movement of member 92 causes chain 96 to pull member 98 downward, toward peddle 80, which, in turn, causes chain 102 to frictionally engage ledge 112 in a counterclockwise direction, causing rod 18' (portion 100 of beater 16) to rotate in a counterclockwise direction thereby causing beater 16 to strike drum 128 (shown in phantom FIG. 2). When peddle 80 is released and rises, the tension of chains 90, 96 and 102 are released, and spring 120 causes beater 16 to return to its normal non-drum contacting position. As before, the tension in spring 120 may be adjusted by screw member 122, which is substantially similar to member 66. Peddles 80 and 28 rotate within device 12 around stationary block 150.

It should be obvious that peddles 28 and 80 allow beaters 14 and 16 to independently and/or simultaneously strike drum 28 by use of a single foot utilizing the device. That is, a single foot is placed upon peddles 80 and 28. Specifically, peddle 28 is activated with the heel of the foot while peddle 80 is activated with the toes or frontal portion of the foot. The simultaneous depression of peddles 28 and 80 cause both beaters 14, 16 to strike drum 128 while activating only one of the peddles 28, 80 causes only a single beater to be moved. Hook member 140 is attached to case 12 by screw 142 and selectively attaches device 10 to drum 128. Thus, device 12 allows multiple beater members to selectively and either independently or simultaneously strike a drum with a single foot.

In the preferred embodiment of the invention each of chains 36, 44, 60, 90, 96, and 102 comprise commercially available roller chains. Moreover, members 92 and 38 are substantially similar, each having, in one embodiment, a length of about 1¾" and a thickness of about 0.375". Member 82, in one embodiment, has a diameter of about 1.10" and member 104, in one embodiment, has an average diameter of about 0.75".

It should be appreciated by those of ordinary skill in the art that device 10 reduces the probability of acquiring focal dystonia since a drummer may, in a single beater application, alternate the use of the back and front peddles, thereby alternating the use of different portions of the feet. In this manner, the front portion of the foot is not continually used to activate the percussion device. Secondly, those currently afflicted by this dysfunction, in single beater applications, may use the peddle 28 and only employ the functional back portion of the foot to achieve the desired percussion sound. Two such devices 10 may be used (e.g. only peddle 28 of such devices) to achieve "dual beater" action by a drummer afflicted by this disease, each device only being used with the back portion of the foot.

Lastly, it should also be appreciated that by use of two such devices 10, a drummer, by use of both feet, may now independently control four beaters, thereby creating larger amounts and types of sound and patterns than previously possible.

It is to be understood that the invention is not limited to the exact construction illustrated and described above, but the various changes and modifications may be made without departing from the spirit and scope of the invention as set forth in the following claims.

I claim:

1. A percussion device for use in combination with a drum for allowing a first beater and a second beater to selectively or simultaneously strike said drum by use of a single foot, said percussion device comprising: a first peddle movably connected to said first beater by a first chain drive; and a second peddle movably connected to said second beater by a second chain drive; a stationary block; said first peddle comprising a first movable portion pivotally connected to a front end of said stationary block of said device facing said drum; said second peddle comprising a second movable portion pivotally connected to a rear end of said stationary block of said device facing away from said drum.

* * * * *